US011538381B2

(12) United States Patent
Cheng

(10) Patent No.: US 11,538,381 B2
(45) Date of Patent: Dec. 27, 2022

(54) GATE DRIVE UNIT, GATE DRIVE CIRCUIT, DRIVE METHOD AND DISPLAY APPARATUS

(71) Applicants: Beijing BOE Technology Development Co., Ltd., Beijing (CN); BOE Technology Group Co., Ltd., Beijing (CN)

(72) Inventor: Hongfei Cheng, Beijing (CN)

(73) Assignees: Beijing BOE Technology Development Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 8 days.

(21) Appl. No.: 17/213,261

(22) Filed: Mar. 26, 2021

(65) Prior Publication Data

US 2021/0407360 A1 Dec. 30, 2021

(30) Foreign Application Priority Data

Jun. 30, 2020 (CN) ..... 202010613150.5

(51) Int. Cl.
*G09G 3/20* (2006.01)

(52) U.S. Cl.
CPC ..... *G09G 3/20* (2013.01); *G09G 2300/0426* (2013.01); *G09G 2310/08* (2013.01)

(58) Field of Classification Search
CPC ..... G09G 3/20; G09G 2300/0426; G09G 2310/08; G09G 2310/0267; G09G 2310/0286
See application file for complete search history.

(56) References Cited

U.S. PATENT DOCUMENTS

| | | | | |
|---|---|---|---|---|
| 9,190,170 | B1 * | 11/2015 | Hao | G11C 19/184 |
| 9,799,293 | B2 * | 10/2017 | Xiao | G09G 3/3696 |
| 9,875,706 | B1 * | 1/2018 | Gong | G09G 3/36 |
| 9,875,709 | B2 * | 1/2018 | Li | G09G 3/3677 |
| 10,217,429 | B1 * | 2/2019 | Shi | G09G 3/3677 |
| 10,937,516 | B2 * | 3/2021 | Tao | G09G 3/3225 |
| 2014/0049712 | A1 * | 2/2014 | Yu | G09G 3/3688 377/69 |
| 2014/0062846 | A1 * | 3/2014 | Cao | G09G 3/3648 345/92 |
| 2017/0032752 | A1 * | 2/2017 | Huang | G11C 19/28 |
| 2017/0162153 | A1 * | 6/2017 | Zhao | G09G 3/3696 |

(Continued)

*Primary Examiner* — Grant Sitta
(74) *Attorney, Agent, or Firm* — Ling Wu; Stephen Yang; Ling and Yang Intellectual Property

(57) ABSTRACT

Provided are a gate drive unit, a gate drive circuit, a drive method and a display apparatus. The gate drive unit includes an input control module, an input module, a potential pull-down module, a first output module, a second output module, an isolation module, a first node and a second node, wherein the input control module controls operation of the input module under action of a second input signal and a first clock signal; the input module transmits a second clock signal to the second node under control of the input control module; the potential pull-down module pulls down a potential of the second node under action of a potential of the first node; the first output module outputs a first output signal under action of the potential of the first node, the potential of the second node and the first clock signal.

19 Claims, 5 Drawing Sheets

(56) References Cited

U.S. PATENT DOCUMENTS

| | | | | |
|---|---|---|---|---|
| 2017/0236479 | A1* | 8/2017 | Li | G11C 19/28 345/213 |
| 2017/0236480 | A1* | 8/2017 | Dai | G09G 3/3677 345/213 |
| 2017/0323608 | A1* | 11/2017 | Gong | G09G 3/3677 |
| 2018/0040600 | A1* | 2/2018 | Li | H01L 27/0207 |
| 2019/0130858 | A1* | 5/2019 | Xiao | G09G 3/3677 |
| 2020/0098327 | A1* | 3/2020 | Dai | G09G 3/3677 |
| 2021/0090484 | A1* | 3/2021 | Shang | G09G 3/20 |
| 2021/0335176 | A1* | 10/2021 | Qian | G11C 19/28 |
| 2021/0366354 | A1* | 11/2021 | Li | G09G 3/007 |

* cited by examiner

GATE DRIVE UNIT, GATE DRIVE CIRCUIT, DRIVE METHOD AND DISPLAY APPARATUS

CROSS-REFERENCE TO RELATED APPLICATION

The present application claims the priority of Chinese Patent Application No. 202010613150.5 filed to the CNIPA on Jun. 30, 2020, the content of which is hereby incorporated by reference.

TECHNICAL FIELD

Embodiments of the present disclosure relate to, but are not limited to, the technical field of display, in particular, gate drive unit, gate drive circuit, drive method and display apparatus.

BACKGROUND

In recent years, development of displays shows a trend of high integration and low cost. One of the technologies is an achievement of mass production of Gate Driver on Array (GOA). A gate switch circuit is integrated on an array substrate of a display panel by using the GOA technology, so that an integrated circuit part for gate drive may be omitted, and costs in aspects of materials and manufacturing processes may be reduced. The display panel may be aesthetically designed with symmetrical sides and narrow bezel. Such gate switch circuit integrated on the array substrate by GOA technology is referred to as a GOA circuit or shift register circuit. At present, stability of a gate drive signal of the GOA circuit needs to be improved.

SUMMARY

The following is a summary of the subject matter described in detail in the present disclosure. This summary is not intended to limit the protection scope of the claims.

In a first aspect, an embodiment of the present disclosures provide a gate drive unit, which includes an input control module, an input module, a potential pull-down module, a first output module, a second output module, an isolation module, a first node and a second node.

The input control module is configured to control operation of the input module under action of a second input signal and a first clock signal.

The input module is configured to transmit a second clock signal to the second node under control of the input control module.

The potential pull-down module is configured to pull down a potential of the second node under action of a potential of the first node.

The first output module is configured to output a first output signal under the action of the potential of the first node, the potential of the second node and the first clock signal.

The second output module is configured to output a second output signal under action of the first input signal and the potential of the first node.

The isolation module is configured to isolate influence of the first node on the first output signal under action of a feedback signal of the first output module.

In an exemplary embodiment, the input control module includes a second transistor, a fourth transistor and a first energy storage capacitor.

A gate of the second transistor is configured to receive the second input signal, a first electrode of the second transistor is connected to a first power supply signal, and a second electrode of the second transistor is connected to the input module.

A gate of the fourth transistor is configured to receive the first clock signal, a first electrode of the fourth transistor is connected to the first power supply signal, and a second electrode of the fourth transistor is connected to the second electrode of the second transistor.

A first electrode of the first energy storage capacitor is configured to receive the second clock signal, and a second electrode of the first energy storage capacitor is connected to the second electrode of the second transistor.

In an exemplary embodiment, the input module includes a fifth transistor and a ninth transistor.

A gate of the fifth transistor is connected to the input control module, a first electrode of the fifth transistor is configured to receive the second clock signal, and a second electrode of the fifth transistor is connected to the second node.

A gate of the ninth transistor is connected to the second node, a first electrode of the ninth transistor is connected to the first power supply, and a second electrode of the ninth transistor is connected to the first node.

In an exemplary embodiment, the potential pull-down module includes a third transistor.

A gate of the third transistor is connected to a first node, a first electrode of the third transistor is configured to receive the first power supply signal, and a second electrode of the third transistor is connected to the second node.

In an exemplary embodiment, the first output module includes a second energy storage capacitor, a third energy storage capacitor, a seventh transistor and an eighth transistor.

A first electrode of the second energy storage capacitor is configured to receive the first power supply signal, and a second electrode of the second energy storage capacitor is connected to the second node.

A first electrode of the third energy storage capacitor is connected to a first output node, and a second electrode of the third energy storage capacitor is connected to the first node.

A gate of the seventh transistor is connected to the second node, a first electrode of the seventh transistor is configured to receive the first power supply signal, and a second electrode of the seventh transistor is connected to the first output node.

A gate of the eighth transistor is connected to the first node, a first electrode of the eighth transistor is configured to receive the first clock signal, and a second electrode of the eighth transistor is connected to the first output node.

In an exemplary embodiment, the second output module includes a first transistor.

A gate of the first transistor is configured to receive a first input signal, a first electrode of the first transistor is configured to receive a second power supply signal, a second electrode of the first transistor is configured to output the second output signal, and the second electrode is connected to the first node.

In an exemplary embodiment, the isolation module includes a sixth transistor;

A gate of the sixth transistor is configured to receive a second power supply signal, a first electrode of the sixth transistor is connected to the second electrode of the third energy storage capacitor, and the second electrode is connected to a first node.

In a second aspect, the present disclosure provides a gate drive circuit, including any of the above-mentioned cascaded gate drive units, wherein a first output node of each level of gate drive unit is respectively connected to a gate line which is in one-to-one correspondence with the first output node.

The first output signal and the second output signal of each of the other gate drive units except a first level of gate drive unit and a last gate level of drive unit respectively serve as a first input signal and a second input signal of a subsequent level of gate drive unit.

The gate drive circuit further includes a first clock signal line and a second clock signal line which are connected to each gate drive unit, wherein the first clock signal line is configured to provide the first clock signal and the second clock signal line is configured to provide the second clock signal.

In a third aspect, an embodiment of the present disclosure provides a display apparatus, including any of the above-mentioned gate drive circuits.

In a fourth aspect, an embodiment of the present disclosure provides a drive method for any of the above-mentioned gate drive units, the method includes:

the input control module prohibiting input module from operating under the action of the second input signal; the potential pull-down module pulling down a potential of the second node under the action of a potential of the first node; the first output module outputting the first clock signal and prohibiting the isolation module from operating under the action of the potential of the first node; the second output module outputting a high-level signal under the action of the first input signal;

the input control module prohibiting the input module from operating under the action of the first clock signal; the potential pull-down module pulling down the potential of the second node under the action of the potential of the first node; the first output module outputting the first clock signal to enable the isolation module to operate under the action of the potential of the first node, and the isolation module isolating the influence of the potential of the first node on the first output signal; the second output module outputting a high-level signal under the action of the potential of the first node;

the input control module enabling the input module to operate under the action of the first clock signal and the second input signal; the input module pulling up the potential of the second node, pulling down the potential of the first node and prohibiting the potential pull-down module from operating under the action of the second clock signal; the first output module outputting a low-level signal and prohibiting the isolation module from operating under the action of the potential of the second node; the second output module outputting a low-level signal under the action of the potential of the first node; and the input control module prohibiting the input module from transmitting the second clock signal under the action of the first clock signal and the second input signal; the input module pulling down the potential of the first node and prohibiting the potential pull-down module from operating under the action of the potential of the second node; the first output module outputting a low-level signal and prohibiting the isolation module from operating under the action of the potential of the second node; the second output module outputting a low-level signal under the action of the potential of the first node.

Other aspects will become apparent upon reading and understanding accompanying drawings and the detailed description.

BRIEF DESCRIPTION OF DRAWINGS

Other features, objects and advantages of the present disclosure will become more apparent by reading the detailed description of non-limiting embodiments made with reference to the following drawings.

DETAILED DESCRIPTION

The following is a further detailed description of the present disclosure with reference to accompanying drawings and examples. It may be understood that the specific embodiments described here are only used to explain related inventions, but not to limit the present invention. In addition, in order to facilitate the description, only the parts related to the invention are shown in the accompanying drawings.

Unless otherwise defined, technical terms or scientific terms used in the present disclosure shall have common meanings as construed by those of ordinary skills in the art to which the present invention pertains. The words "first", "second" and the like used in the present disclosure do not indicate any order, quantity or importance, but are only used to distinguish different components. Words such as "comprising", "including", or the like, mean that the elements or articles preceding the word cover elements or articles listed after the word and their equivalents, and do not exclude other elements or articles. Similar words such as "connect" or "link" are not limited to physical or mechanical connections, but may include electrical connections, whether direct or indirect. "Up", "down", "left", "right" and the like are merely used to indicate a relative positional relationship. Upon the change of an absolute position of a described object, the relative positional relation may also change accordingly.

It should be noted that embodiments in the present disclosure and features in the embodiments may be combined with each other if there is no conflict. Hereinafter, the present disclosure will be described in detail with reference to the drawings and in combination with embodiments.

Figure 1:
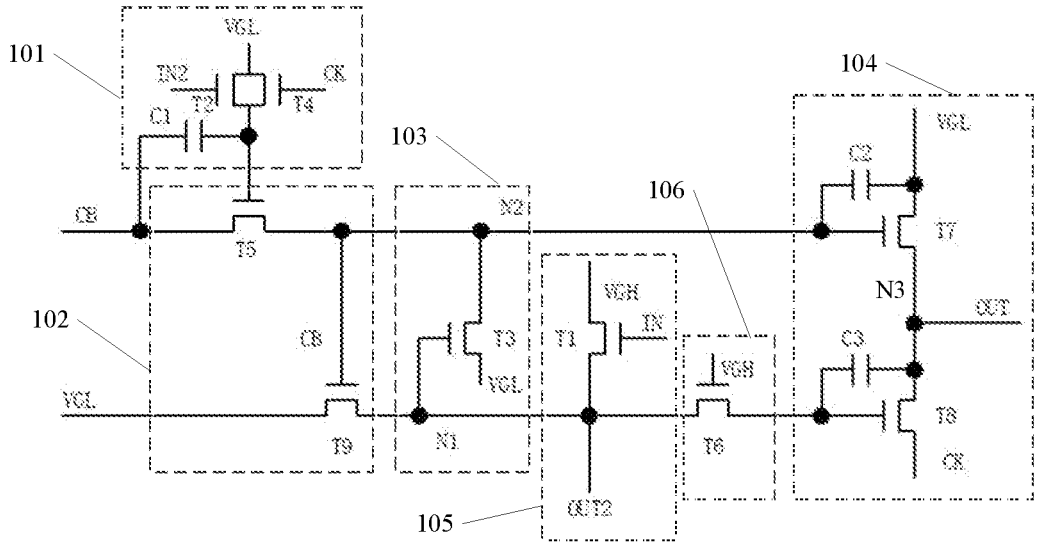
FIG. 1 illustrates a block diagram of an exemplary structure of a gate drive unit according to an embodiment of the present disclosure.

Please refer to FIG. 1, FIG. 1 shows a block diagram of an exemplary structure of a gate drive unit according to an embodiment of the present disclosure.

The present disclosure discloses a gate drive unit, which includes an input control module 101, an input module 102, a potential pull-down module 103, a first output module 104, a second output module 105, an isolation module 106, a first node N1 and a second node N2.

The input control module 101 is configured to control operation of the input module 102 under action of a second input signal IN2 and a first clock signal CK.

The input module 102 is configured to transmit a second clock signal CB to the second node N2 under control of the input control module 101.

The potential pull-down module 103 is configured to pull down a potential of the second node N2 under action of a potential of the first node N1.

The first output module 104 is configured to output a first output signal OUT under action of the potential of the first node N1, the potential of the second node N2 and the first clock signal CK.

The second output module 105 is configured to output a second output signal OUT2 under action of a first input signal IN and the potential of the first node N1.

The isolation module 106 is configured to isolate influence of the first node N1 on the first output signal OUT under action of a feedback signal of the first output module 104.

In the embodiment of the disclosure, by disposing the isolation module which can isolate the influence of the first node on the first output signal under the action of the feedback signal of the first output module, the stability problem of the output signal can be solved.

The structure of each module is described one by one as follows.

The input control module 101 includes a second transistor T2, a fourth transistor T4 and a first energy storage capacitor C1. A gate of the second transistor T2 receives the second input signal IN2, a first electrode of the second transistor T2 is connected to a first power supply signal VGL, and a second electrode of the second transistor T2 is connected to the input module 102. A gate of the fourth transistor T4 receives the first clock signal CK, a first electrode of the fourth transistor T4 is connected to the first power supply signal VGL, and a second electrode of the fourth transistor T4 is connected to the second electrode of the second transistor T2. The first electrode of the first energy storage capacitor C1 receives the second clock signal CB, and a second electrode of the first energy storage capacitor C1 is connected to the second electrode of the second transistor T2.

The input module 102 includes a fifth transistor T5 and a ninth transistor T9. A gate of the fifth transistor T5 is connected to the input control module 101, a first electrode of the fifth transistor T5 receives the second clock signal CB, and a second electrode of the fifth transistor T5 is connected to the second node N2. A gate of the ninth transistor T9 is connected to the second node N2, a first electrode of the ninth transistor T9 is connected to the first power supply signal VGL, and a second electrode of the ninth transistor T9 is connected to the first node N1.

The potential pull-down module 103 includes a third transistor T3, wherein a gate of the third transistor T3 is connected to the first node N1, a first electrode of the third transistor T3 receives the first power supply signal VGL, and a second electrode of the third transistor T3 is connected to the second node N2.

The first output module 104 includes a second energy storage capacitor C2, a third energy storage capacitor C3, a seventh transistor T7 and an eighth transistor T8. A first electrode of the second energy storage capacitor C2 receives the first power supply signal VGL, and a second electrode of the second energy storage capacitor C2 is connected to the second node N2. A first electrode of the third energy storage capacitor C3 is connected to a first output node N3, and a second electrode of the third energy storage capacitor C3 is connected to the first node N1. A gate of the seventh transistor T7 is connected to the second node N2, a first electrode of the seventh transistor T7 receives the first power supply signal VGL, and a second electrode of the seventh transistor T7 is connected to the first output node N3 A gate of the eighth transistor T8 is connected to the first node N1, a first electrode of the eighth transistor T8 receives the first clock signal CK, and a second electrode of the eighth transistor T8 is connected to the first output node N3.

The second output module 105 includes a first transistor T1, wherein a gate of the first transistor T1 receives the first input signal IN, wherein a first electrode of the first transistor T1 receives a second power supply signal VGH, a second electrode of the first transistor T1 outputs the second output signal, and the second electrode is connected to the first node N1.

The isolation module 106 includes a sixth transistor T6, wherein a gate of the sixth transistor T6 receives the second power supply signal VGH, a first electrode of the sixth transistor T6 is connected to the second electrode of the third energy storage capacitor C3, and a second electrode of the sixth transistor T6 is connected to the first node N1.

Operation process of the gate drive unit of FIG. 1 is described in detail in FIGS. 3 to 8.

Figure 2:
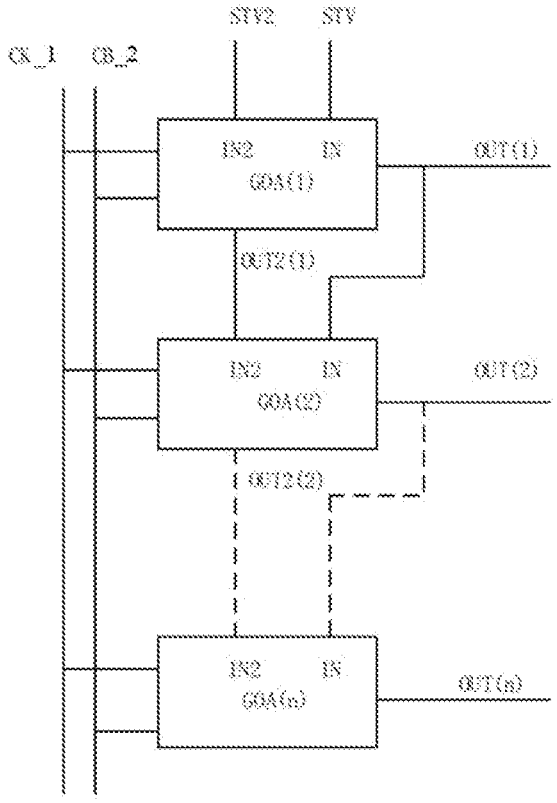
FIG. 2 illustrates a block diagram of an exemplary structure of a gate drive circuit according to an embodiment of the present disclosure.

Please refer to FIG. 2, FIG. 2 shows a block diagram of an exemplary structure of a gate drive circuit according to an embodiment of the present disclosure.

An embodiment of the present disclosure further provides a gate drive circuit, which includes the gate drive units GOA provided in the foregoing embodiment of the present disclosure, wherein the first output node N3 of each level of the gate drive units GOA is connected to a one-to-one corresponding gate line;

Except the first level of gate drive unit and the last level of gate drive unit, the first output signal OUT and the second output signal OUT2 of other gate drive units respectively serve as the first input signal IN and the second input signal IN2 of the subsequent level of gate drive units.

The gate drive circuit further includes a first clock signal line CK_1 and a second clock signal line CB_2 connected to each gate drive unit, wherein the first clock signal line CK_1 provides a first clock signal CK and the second clock signal CB_2 provides a second clock signal CB.

As shown in FIG. 2, the gate drive circuit includes cascaded gate drive units GOA(1) to GOA(n). Each gate drive unit GOA includes a first output signal OUT(1) to a first output signal OUT(n), and each output signal is connected to a corresponding gate line to drive a pixel drive circuit. Among them, a first frame start signal STV serves as a first input signal IN of a first gate drive unit GOA(1), and a second frame start signal STV2 serves as a second input signal IN2 of the first gate drive unit GOA(1). A first output signal OUT and a second output signal OUT2 of each of other gate drive units except the first gate drive unit GOA(1) and the last gate drive unit GOA(n) respectively serve as a first input signal IN and a second input signal IN2 of a subsequent level of gate drive unit. For example, the first output signal OUT of the gate drive unit GOA(1) serves as a first input signal IN of a subsequent level of gate drive unit GOA(2), and the second output signal OUT2 of the gate drive unit GOA(1) serves as a second input signal IN2 of the subsequent level of gate drive unit GOA(2). By analogy, a first output signal OUT of the gate drive unit GOA(2) serves as a first input signal IN of a subsequent level of gate drive unit GOA(3) (not shown in the Figure), and a second output signal OUT2 of the gate drive unit GOA(2) respectively serve as the first input signal IN and the second input signal IN2 of the subsequent level of gate drive unit GOA(3) (not shown in the Figure).

The present disclosure further discloses a display apparatus, which includes the gate drive circuit according to each embodiment of the present disclosure.

Figure 3:
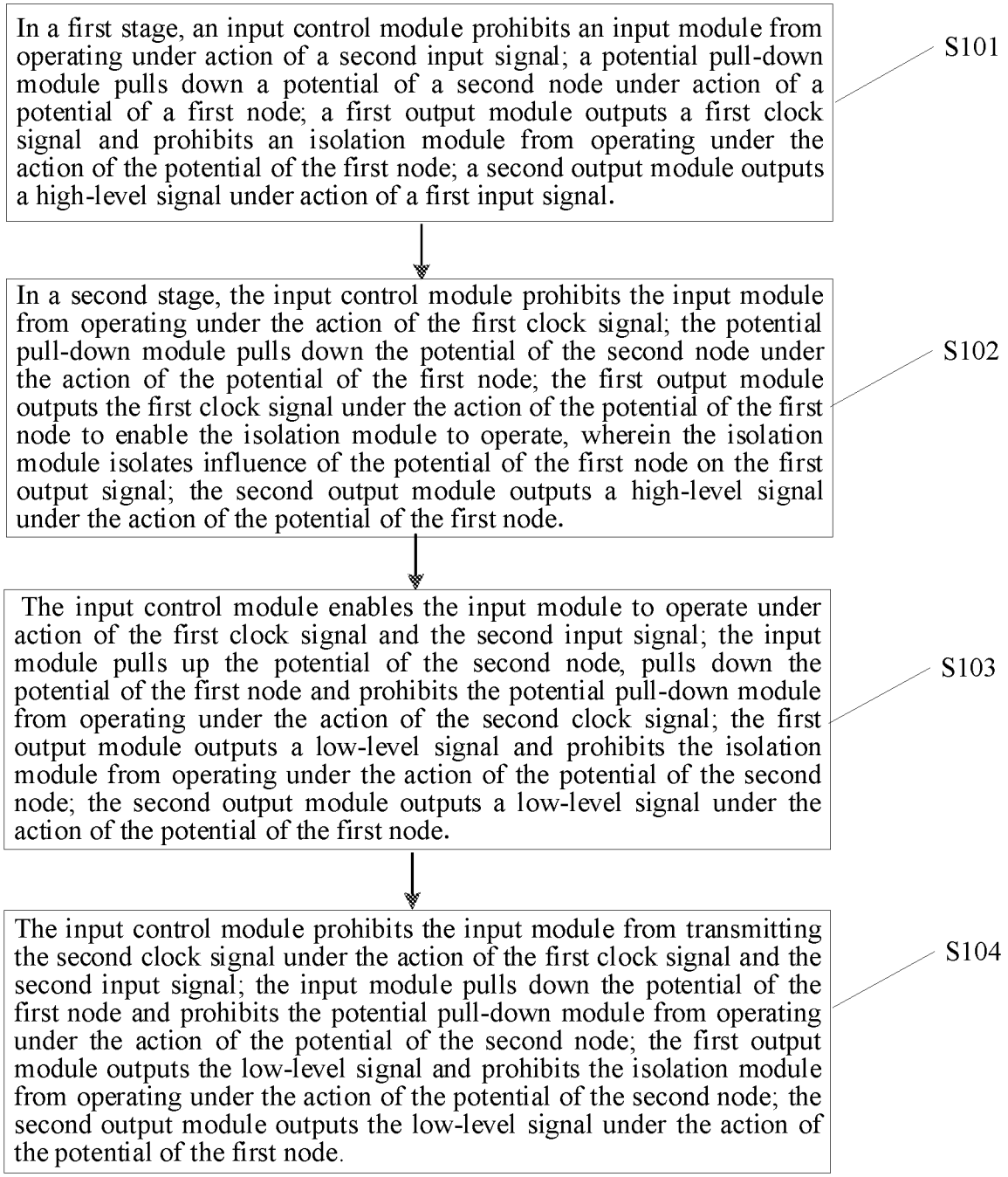
FIG. 3 illustrates an exemplary flowchart of a drive method for a gate drive unit according to an embodiment of the present disclosure.

Please refer to FIG. 3, which shows an exemplary flowchart of a drive method for a gate drive unit according to an embodiment of the present disclosure. The drive method includes the following stages:

S101: In a first stage, an input control module prohibits an input module from operating under action of a second input signal; a potential pull-down module pulls down a potential of a second node under action of a potential of a first node; a first output module outputs a first clock signal and prohibits an isolation module from operating under the action of the potential of the first node; a second output module outputs a high-level signal under the action of a first input signal.

S102: In a second stage, the input control module prohibits the input module from operating under the action of the first clock signal; the potential pull-down module pulls down the potential of the second node under the action of the potential of the first node; the first output module outputs the first clock signal under the action of the potential of the first node to enable the isolation module to operate, wherein the isolation module isolates influence of the potential of the first node on the first output signal; the second output module outputs a high-level signal under the action of the potential of the first node.

S103: In a third stage, the input control module enables the input module to operate under action of the first clock signal and the second input signal; the input module pulls up the potential of the second node, pulls down the potential of the first node and prohibits the potential pull-down module from operating under the action of the second clock signal; the first output module outputs a low-level signal and prohibits the isolation module from operating under the action of the potential of the second node; the second output module outputs a low-level signal under the action of the potential of the first node.

S104: In a fourth stage, the input control module prohibits the input module from transmitting the second clock signal under the action of the first clock signal and the second input signal; the input module pulls down the potential of the first node and prohibits the potential pull-down module from operating under the action of the potential of the second node; the first output module outputs the low-level signal and prohibits the isolation module from operating under the action of the potential of the second node; the second output module outputs the low-level signal under the action of the potential of the first node.

Figure 4:
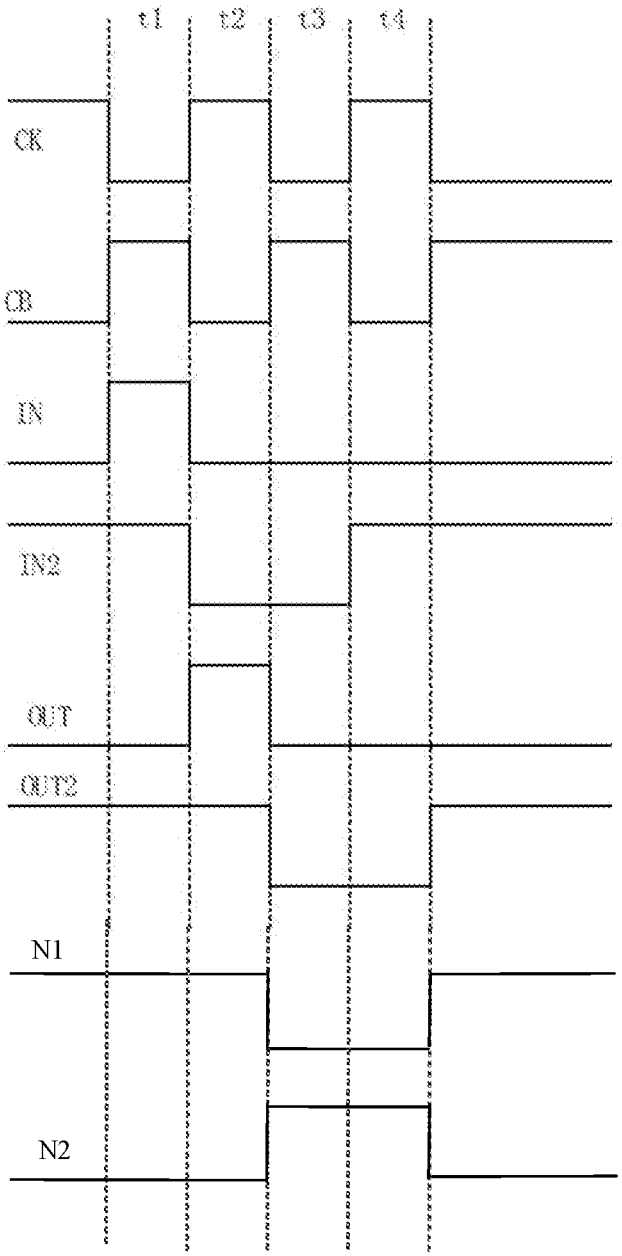
FIG. 4 illustrates an exemplary sequence diagram of a gate drive unit according to an embodiment of the present disclosure.

Each stage will be described with reference to FIG. 2 and FIG. 4 to FIG. 8. FIG. 4 shows an exemplary sequence diagram of a gate drive unit according to an embodiment of the present disclosure; FIG. 5 to FIG. 8 show specific exemplary diagrams of a drive method for a gate drive unit according to each stage in FIG. 3.

Figure 5:
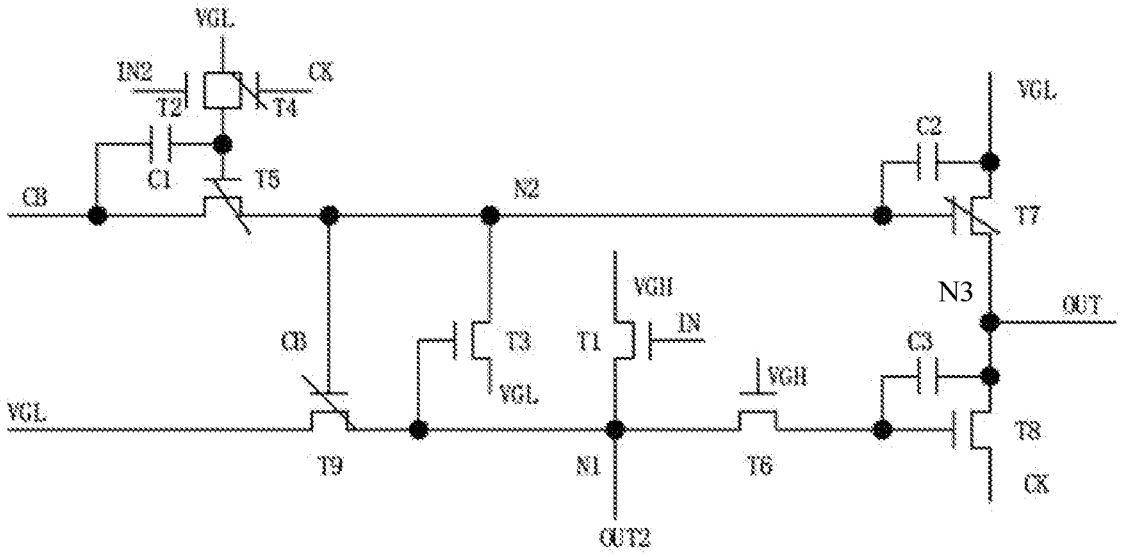
FIG. 5 to FIG. 8 illustrate specific exemplary diagrams of the drive method for the gate drive unit according to each stage in FIG. 3.

As shown in FIG. 4 and FIG. 5, in a first stage t1, a first clock signal CK is at a low level, a second clock signal CB is at a high level, a first input signal IN is at a high level, a second input signal IN2 is at a high level, a first power supply signal VGL is at a low level, and a second power supply signal VGH is at a high level. At this time, a second transistor T2 whose gate is connected to the second input signal IN2 is turned on, making the low level of the first power supply signal transmitted to a gate of a fifth transistor T5. The fourth transistor T4 whose gate is connected to the first clock signal is turned off and the fifth transistor T5 whose gate is connected to the first power supply signal VGL is turned off. A first transistor T1 connected to the first input signal IN is turned on, making the second power supply signal VGH transmitted to a first node N1, the first node N1 is at a high level, and the output second output signal OUT2 is at a high level. A third transistor T3 whose gate is connected to the first node N1 is turned on and the first power supply signal VGL is transmitted to a second node N2, wherein the second node N2 is at a low level. A ninth transistor T9 whose gate is connected to the second node N2 is turned off; a seventh transistor T7 whose gate is connected to the second node N2 is turned off; a sixth transistor T6 whose gate is connected to the second power supply signal VGH is turned on, and an eighth transistor T8 whose gate is connected to signal of the first node N1 with a high level is turned on. The eighth transistor T8 transmits the first clock signal CK with a low level to a first output node N3 and outputs a first output signal OUT. A second storage capacitor C2 is configured to store a gate voltage of the seventh transistor T7, a third storage capacitor C3 is configured to store a gate voltage of the eighth transistor T8, and a first storage capacitor C1 is configured to store a gate voltage of the fifth transistor T5. In FIG. 5, for the convenience of viewing, transistors in a turned-off state are denoted by diagonal lines.

Figure 6:
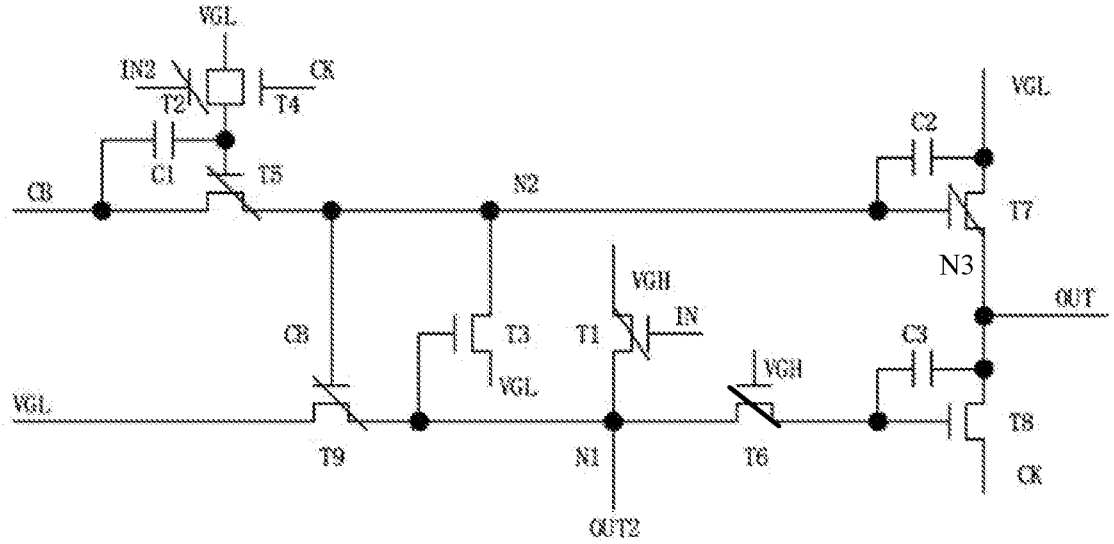

As shown in FIG. 4 and FIG. 6, in a second stage, the first clock signal CK is at a high level, the second clock signal CB is at a low level, the first input signal IN is at a low level, the second input signal IN2 is at a low level, the first power supply signal VGL is at a low level, and the second power supply signal VGH is at a high level. At this time, the second transistor T2 whose gate is connected to the second input signal IN2 is turned off; the fourth transistor T4 whose gate is connected to the first clock signal is turned on, making the low level of the first power supply signal written into the gate of the fifth transistor T5; the fifth transistor T5 whose gate is connected to the first power supply signal VGL is turned off. The second node N2 maintains the low level of the previous stage (see stage t1), and the ninth transistor T9 whose gate is connected to the second node N2 is turned off. The first node N1 maintains the high level of the previous stage (see stage t1), the third transistor T3 connected to the first node N1 is turned on, the first power supply signal VGL is transmitted to the second node N2, and the second node N2 still maintains the low level. The seventh transistor T7 whose gate is connected to the first node N1 is turned off; the first transistor T1 connected to the first input signal IN is turned off, the first node maintains the high level, and the second output signal OUT2 is at the high level under the action of the potential of the first node N1. The sixth transistor T6 whose gate is connected to the second power supply signal VGH is turned on, and the eighth transistor T8 whose gate is connected to the signal of the first node N1 with the high level is turned on, and the eighth transistor T8 outputs the first clock signal CK with the high level as the first output signal OUT. Due to the action of the third energy storage capacitor C3, a gate voltage of the eighth transistor T8 is pulled up and higher than that of the second power supply signal VGH, making output capability of the eighth transistor T8 increased, the sixth transistor T6 turned off, and the gate of the eighth transistor T8 isolated from the first node N1, resulting in more stable output. In FIG. 6, for the convenience of viewing, transistors in the turned-off state are denoted by diagonal lines.

Figure 7:
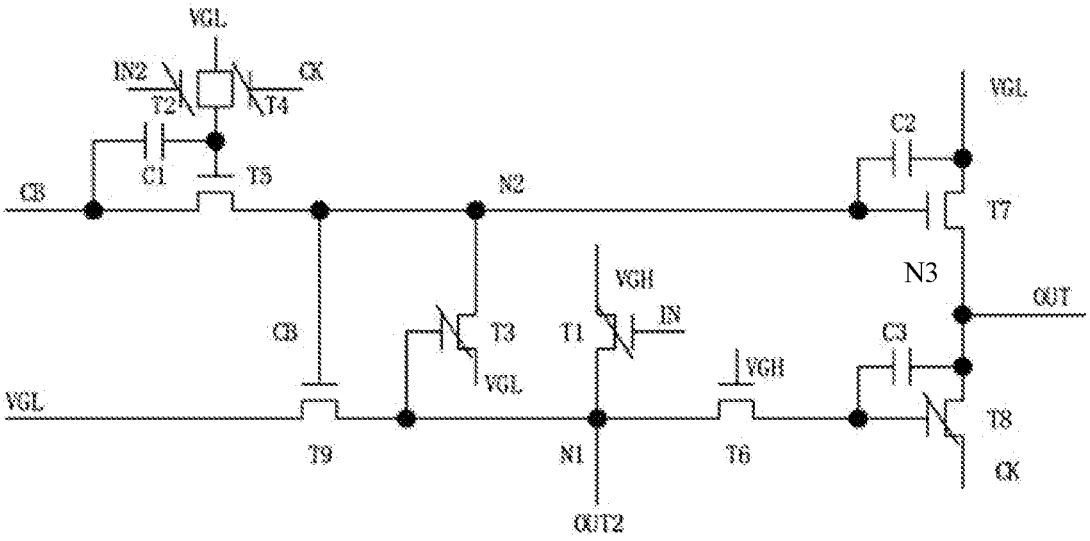

As shown in FIG. 4 and FIG. 7, in a third stage: the first clock signal CK is at the low level, the second clock signal CB is at the high level, the first input signal IN is at the low level, the second input signal IN2 is at the low level, the first power supply signal VGL is at the low level, and the second power supply signal VGH is at the high level, at this time, the second transistor T2 whose gate is connected to the second input signal IN2 is turned off; the fourth transistor T4 whose gate is connected to the first clock signal is turned off. Under the action of the high level of the second clock signal CB, the second energy storage capacitor C1 changes a gate potential of the fifth transistor T5 from the low level in stage t2 to the high level in stage t3, so that the fifth transistor T5 is turned on, besides, the second clock signal is transmitted to the second node, making the signal be at a high level. The ninth transistor T9 whose gate is connected to the second node N2 is turned on, and the first power supply signal with a low level is transmitted to the first node, wherein the first node N1 is at the low level. The third transistor T3 whose gate is connected to the first node N1 is turned off; the seventh transistor T7 whose gate is connected to the second node N2 is turned on, and the first power supply signal with the low level is transmitted to the first output node N3 and outputs the first output signal OUT. The first transistor T1 connected to the first input signal IN is turned off, and at this time the second output signal OUT2 outputs a low level under the action of the potential of the first node N1. The sixth transistor T6 whose gate is connected to the second power supply signal VGH is turned on and the eighth transistor T8 whose gate is connected to the signal of first node N1 with a low level is turned off. In FIG. 7, for the convenience of viewing, transistors in the turned-off state are denoted by diagonal lines.

Figure 8:
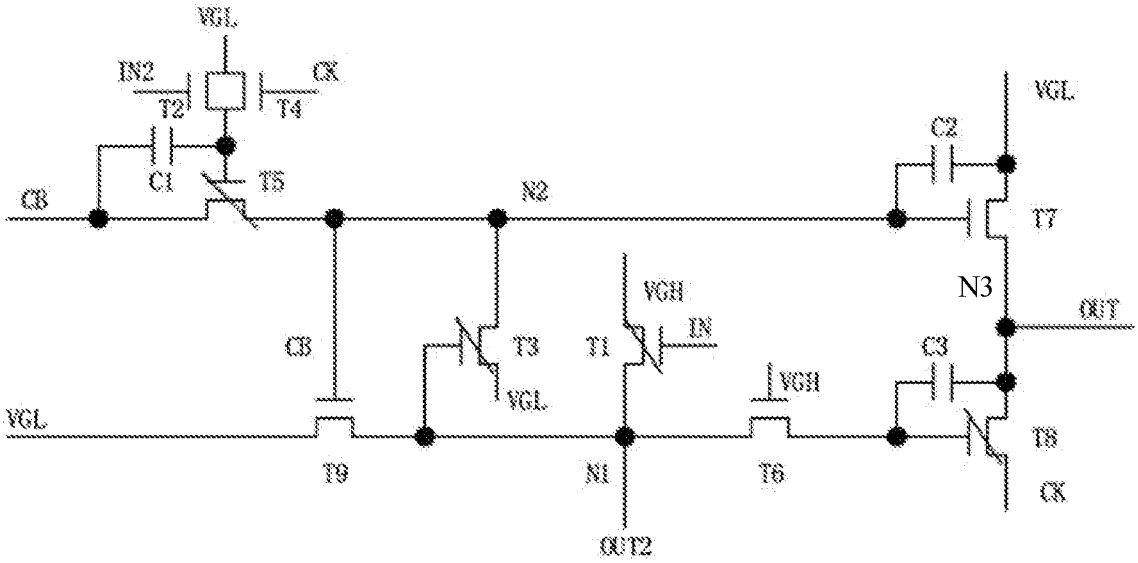

As shown in FIG. 4 and FIG. 8, in a fourth stage, the first clock signal CK is at the high level, the second clock signal CB is at the low level, the first input signal IN is at the low level, the second input signal IN2 is at the high level, the first power supply signal VGL is at the low level, and the second power supply signal VGH is at the high level. At this time, the second transistor T2 whose gate is connected to the second input signal IN2 is turned on, the fourth transistor T4 whose gate is connected to the first clock signal is turned on, making the low level of the first power supply signal written into the gate of the fifth transistor T5; the fifth transistor T5 whose gate is connected to the first power supply signal VGL is turned off; the second node N2 maintains the high level of the previous stage (stage t3), and the ninth transistor T9 whose gate is connected to the second node N2 is turned on and transmits the first power supply signal with a low level to the first node, wherein the first node N1 is at a low level. The third transistor T3 whose gate is connected to the first node N1 is turned off; the seventh transistor T7 whose gate is connected to the second node N2 is turned on, transmits the first power supply signal with the low level to the first output node N3 and outputs the first output signal OUT. The first transistor T1 connected to the first input signal IN is turned off, and at this time the second output signal OUT2 outputs the low level under the action of the potential of the first node N1. The sixth transistor T6 whose gate is connected to the second power supply signal VGH is turned on and the eighth transistor T8 whose gate is connected to the signal of first node N1 with a low level is turned off. In FIG. 8, for the convenience of viewing, transistors in the turned-off state are denoted by diagonal lines.

The above description is only exemplary embodiments of the present disclosure and an illustration of the technical principles applied. Those skilled in the art should understand that the scope of the invention involved in the present disclosure is not limited to the technical solution formed by the specific combination of the above technical features, but also covers other technical solutions formed by any combination of the above technical features or their equivalent features without departing from the inventive concept. For example, the technical solutions formed by replacing the above features with the technical features with similar functions disclosed (but not limited to) in the present disclosure.

What is claimed is:

1. A gate drive circuit comprising cascaded gate drive units, wherein each of the gate drive units comprises an input control module, an input module, a potential pull-down module, a first output module, a second output module, an isolation module, a first node and a second node, wherein, the input control module is configured to control operation of the input module under action of a second input signal and a first clock signal;

the input module is configured to transmit a second clock signal to the second node under control of the input control module;

the potential pull-down module is configured to pull down a potential of the second node under action of a potential of the first node;

the first output module is configured to output a first output signal under action of the potential of the first node, the potential of the second node and the first clock signal;

the second output module is configured to output a second output signal under action of the first input signal and the potential of the first node; and the isolation module is configured to isolate influence of the first node on the first output signal under action of a feedback signal of the first output module;

wherein the input control module comprises a second transistor, a fourth transistor and a first energy storage capacitor;

a gate of the second transistor is configured to receive the second input signal, a first electrode of the second transistor is connected to a first power supply signal, and a second electrode of the second transistor is connected to the input module;

a gate of the fourth transistor is configured to receive the first clock signal, a first electrode of the fourth transistor is connected to the first power supply signal, and a second electrode of the fourth transistor is connected to the second electrode of the second transistor; and a first electrode of the first energy storage capacitor is configured to receive the second clock signal, and a second electrode of the first energy storage capacitor is connected to the second electrode of the second transistor.

2. The gate drive circuit of claim 1, wherein the input module comprises a fifth transistor and a ninth transistor;

a gate of the fifth transistor is connected to the input control module, a first electrode of the fifth transistor is configured to receive the second clock signal, and a second electrode of the fifth transistor is connected to the second node; and a gate of the ninth transistor is connected to the second node, a first electrode of the ninth transistor is connected to the first power supply, and a second electrode of the ninth transistor is connected to the first node.

3. The gate drive circuit of claim 1, wherein the potential pull-down module comprises a third transistor;

a gate of the third transistor is connected to a first node, a first electrode of the third transistor is configured to receive the first power supply signal, and a second electrode of the third transistor is connected to the second node.

4. The gate drive circuit of claim 1, wherein the first output module comprises a second energy storage capacitor, a third energy storage capacitor, a seventh transistor and an eighth transistor;

a first electrode of the second energy storage capacitor is configured to receive the first power supply signal, and a second electrode of the second energy storage capacitor is connected to the second node;

a first electrode of the third energy storage capacitor is connected to a first output node, and a second electrode of the third energy storage capacitor is connected to the first node;

a gate of the seventh transistor is connected to the second node, a first electrode of the seventh transistor is configured to receive the first power supply signal, and a second electrode of the seventh transistor is connected to the first output node; and a gate of the eighth transistor is connected to the first node, a first electrode of the eighth transistor is configured to receive the first clock signal, and a second electrode of the eighth transistor is connected to the first output node.

5. The gate drive circuit of claim 1, wherein the second output module comprises a first transistor;

a gate of the first transistor is configured to receive a first input signal, a first electrode of the first transistor is configured to receive a second power supply signal, a second electrode of the first transistor is configured to output the second output signal, and the second electrode is connected to the first node.

6. The gate drive circuit of claim 4, wherein the isolation module comprises a sixth transistor;

a gate of the sixth transistor is configured to receive a second power supply signal, a first electrode of the sixth transistor is connected to the second electrode of the third energy storage capacitor, and the second electrode is connected to the first node.

7. The gate drive circuit of claim 1, wherein a first output node of each level of gate drive unit is respectively connected to a gate line which is in one-to-one correspondence with the first output node; the first output signal and the second output signal of each of the other gate drive units except a first level of gate drive unit and a last level of gate drive unit respectively serve as a first input signal and a second input signal of a subsequent level of gate drive unit; and the gate drive circuit further comprises a first clock signal line and a second clock signal line which are connected to each gate drive unit, wherein the first clock signal line is configured to provide the first clock signal and the second clock signal line is configured to provide the second clock signal.

8. The gate drive circuit of claim 7, wherein the input control module comprises a second transistor, a fourth transistor and a first energy storage capacitor;

a gate of the second transistor is configured to receive the second input signal, a first electrode of the second transistor is connected to a first power supply signal, and a second electrode of the second transistor is connected to the input module;

a gate of the fourth transistor is configured to receive the first clock signal, a first electrode of the fourth transistor is connected to the first power supply signal, and a second electrode of the fourth transistor is connected to the second electrode of the second transistor; and a first electrode of the first energy storage capacitor is configured to receive the second clock signal, and a second electrode of the first energy storage capacitor is connected to the second electrode of the second transistor.

9. The gate drive circuit of claim 7, wherein the input module comprises a fifth transistor and a ninth transistor;

a gate of the fifth transistor is connected to the input control module, a first electrode of the fifth transistor is configured to receive the second clock signal, and a second electrode of the fifth transistor is connected to the second node; and a gate of the ninth transistor is connected to the second node, a first electrode of the ninth transistor is connected to the first power supply, and a second electrode of the ninth transistor is connected to the first node.

10. The gate drive circuit of claim 7, wherein the potential pull-down module comprises a third transistor;

a gate of the third transistor is connected to the first node, a first electrode of the third transistor is configured to receive the first power supply signal, and a second electrode of the third transistor is connected to the second node.

11. The gate drive circuit of claim 7, wherein the first output module comprises a second energy storage capacitor, a third energy storage capacitor, a seventh transistor and an eighth transistor;

a first electrode of the second energy storage capacitor is configured to receive the first power supply signal, and a second electrode of the second energy storage capacitor is connected to the second node;

a first electrode of the third energy storage capacitor is connected to the first output node, and the second electrode of the third energy storage capacitor is connected to the first node;

a gate of the seventh transistor is connected to the second node, a first electrode of the seventh transistor is configured to receive the first power supply signal, and a second electrode of the seventh transistor is connected to the first output node; and a gate of the eighth transistor is connected to the first node, a first electrode of the eighth transistor is configured to receive the first clock signal, and a second electrode of the eighth transistor is connected to the first output node.

12. The gate drive circuit of claim 7, wherein the second output module comprises a first transistor;

a gate of the first transistor is configured to receive a first input signal, a first electrode of the first transistor is configured to receive a second power supply signal, a second electrode of the first transistor is configured to output the second output signal, and the second electrode is connected to the first node.

13. The gate drive circuit of claim 7, wherein the isolation module comprises a sixth transistor;

a gate of the sixth transistor is configured to receive a second power supply signal, a first electrode of the sixth transistor is connected to the second electrode of the third energy storage capacitor, and the second electrode is connected to the first node.

14. A display apparatus, comprising a gate drive circuit which comprises cascaded gate drive units, wherein each of the gate drive units comprise an input control module, an input module, a potential pull-down module, a first output module, a second output module, an isolation module, a first node and a second node; wherein, the input control module is configured to control operation of the input module under action of a second input signal and a first clock signal;

the input module is configured to transmit a second clock signal to the second node under control of the input control module;

the potential pull-down module is configured to pull down a potential of the second node under action of a potential of the first node;

the first output module is configured to output a first output signal under action of the potential of the first node, the potential of the second node and the first clock signal;

the second output module is configured to output a second output signal under action of a first input signal and the potential of the first node;

the isolation module is configured to isolate influence of the first node on the first output signal under action of a feedback signal of the first output module;

a first output node of each level of gate drive unit is respectively connected to a gate lines which is in one-to-one correspondence with the first output node;

the first output signal and the second output signal of each of the other gate drive units except a first level of gate drive unit and a last level of gate drive unit respectively serve as a first input signal and a second input signal of a subsequent level of gate drive unit;

the gate drive circuit further comprises a first clock signal line and a second clock signal line which are connected to each gate drive unit, wherein the first clock signal line is configured to provide the first clock signal and the second clock signal line is configured to provide the second clock signal.

15. The display apparatus of claim 14, wherein the input control module comprises a second transistor, a fourth transistor and a first energy storage capacitor;

a gate of the second transistor is configured to receive the second input signal, a first electrode of the second transistor is connected to the first power supply signal, and a second electrode of the second transistor is connected to the input module;

a gate of the fourth transistor is configured to receive the first clock signal, a first electrode of the fourth transistor is connected to the first power supply signal, and a second electrode of the fourth transistor is connected to the second electrode of the second transistor; and a first electrode of the first energy storage capacitor is configured to receive a second clock signal, and a second electrode of the first energy storage capacitor is connected to the second electrode of the second transistor.

16. The display apparatus of claim 14, wherein the input module comprises a fifth transistor and a ninth transistor;

a gate of the fifth transistor is connected to the input control module, a first electrode of the fifth transistor is configured to receive the second clock signal, and a second electrode of the fifth transistor is connected to the second node; and a gate of the ninth transistor is connected to the second node, a first electrode of the ninth transistor is connected to the first power supply, and a second electrode of the ninth transistor is connected to the first node.

17. The display apparatus of claim 14, wherein the potential pull-down module comprises a third transistor;

a gate of the third transistor is connected to a first node, a first electrode of the third transistor is configured to receive the first power supply signal, and a second electrode of the third transistor is connected to the second node.

18. The display apparatus of claim 14, wherein the first output module comprises a second energy storage capacitor, a third energy storage capacitor, a seventh transistor and an eighth transistor;

a first electrode of the second energy storage capacitor is configured to receive the first power supply signal, and a second electrode of the second energy storage capacitor is connected to the second node;

a first electrode of the third energy storage capacitor is connected to a first output node, and a second electrode of the third energy storage capacitor is connected to the first node;

a gate of the seventh transistor is connected to a second node, a first electrode of the seventh transistor is configured to receive the first power supply signal, and a second electrode of the seventh transistor is connected to the first output node; and a gate of the eighth transistor is connected to the first node, the first electrode of the eighth transistor is configured to receive the first clock signal, and a second electrode of the eighth transistor is connected to the first output node.

19. A drive method for a gate drive unit, wherein, the gate drive unit comprises an input control module, an input module, a potential pull-down module, a first output module, a second output module, an isolation module, a first node and a second node; wherein, the input control module is configured to control operation of the input module under action of a second input signal and a first clock signal;

the input module is configured to transmit a second clock signal to the second node under control of the input control module;

the potential pull-down module is configured to pull down a potential of the second node under action of a potential of the first node;

the first output module is configured to output a first output signal under action of the potential of the first node, the potential of the second node and the first clock signal;

the second output module is configured to output a second output signal under action of a first input signal and the potential of the first node;

the isolation module is configured to isolate influence of the first node on the first output signal under action of a feedback signal of the first output module;

the drive method comprises:

the input control module prohibiting the input module from operating under the action of the second input signal; the potential pull-down module pulling down the potential of the second node under the action of the first node potential; the first output module outputting the first clock signal and prohibiting the isolation module from operating under the action of the potential of the first node; the second output module outputting a high-level signal under the action of the first input signal;

the input control module prohibiting the input module from operating under the action of the first clock signal; the potential pull-down module pulling down the potential of the second node under the action of the potential of the first node; the first output module outputting the first clock signal and enabling the isolation module to operate under the action of the potential of the first node, and the isolation module isolating the influence of the potential of the first node on the first output signal; the second output module outputting a high-level signal under the action of the potential of the first node;

the input control module enabling the input module to operate under the action of the first clock signal and the second input signal; the input module pulling up the potential of the second node, pulling down the potential of the first node and prohibiting the potential pull-down module from operating under the action of the second clock signal; the first output module outputting a low-level signal and prohibiting the isolation module from operating under the action of the potential of the second node; the second output module outputting a low-level signal under the action of the potential of the first node; and the input control module prohibiting the input module from transmitting the second clock signal under the action of the first clock signal and the second input signal; the input module pulling down the potential of the first node and prohibiting the potential pulling-down module from operating under the action of the potential of the second node; the first output module outputting a low-level signal and prohibiting the isolation module from operating under the action of the potential of the second node; the second output module outputting a low-level signal under the action of the potential of the first node.

* * * * *